US005291187A

United States Patent [19]

Wood et al.

[11] Patent Number: 5,291,187

[45] Date of Patent: Mar. 1, 1994

[54] HIGH-SPEED VIDEO DISPLAY SYSTEM

[75] Inventors: Paul B. Wood, Spring; Brian F. Bounds, Cypress, both of Tex.

[73] Assignee: Compaq Computer Corporation, Houston, Tex.

[21] Appl. No.: 695,963

[22] Filed: May 6, 1991

[51] Int. Cl.[5] ..... G09G 1/02

[52] U.S. Cl. ..... 345/185; 345/152

[58] Field of Search ..... 340/703, 723, 721, 701, 340/750, 799, 814, 811

[56] References Cited

U.S. PATENT DOCUMENTS

| | | | |
|---|---|---|---|
| 4,364,037 | 12/1982 | Walker | 340/703 |
| 4,635,048 | 1/1987 | Nishi et al. | 340/750 |
| 4,660,070 | 4/1987 | Nishi et al. | 358/11 |
| 4,688,032 | 8/1987 | Saito et al. | 340/723 |
| 4,872,002 | 10/1989 | Stewart et al. | 340/811 |
| 4,918,436 | 4/1990 | Johary | 340/703 |

OTHER PUBLICATIONS

*Product Selection Guide* (Brooktree Corporation, 1991), pp. 13–14.

*Primary Examiner*—Alvin E. Oberley

*Assistant Examiner*—Xiao M. Wu

*Attorney, Agent, or Firm*—Vinson & Elkins

[57] ABSTRACT

A graphics subsystem, including a video digital-to-analog converter, is disclosed. A high speed oscillator generates a pixel clock signal at the frequency at which pixels are to be displayed. Included in the video DAC is a frequency divider which presents an output clock signal having a period which is a multiple of the pixel clock signal, the multiple corresponding to the level of multiplexing of pixel data to be provided by the video DAC; this multiple can equal unity. The video controller in the system receives the output clock signal, and generates clock signals to control the serial port of the frame memory, and also to control the latching of the first stage in the video DAC. The first stage latch in the video DAC latches in the multiple pixel data from the frame memory, and the multiplexer in the video DAC presents the data to the color palette RAM, or around the color palette RAM in true-color non-multiplexed mode, according to the pixel clock signal. As a result, the pixel clock rate is not dependent by the propagation delay of the output clock signal through the video controller, and higher speed system operation is achieved.

20 Claims, 4 Drawing Sheets

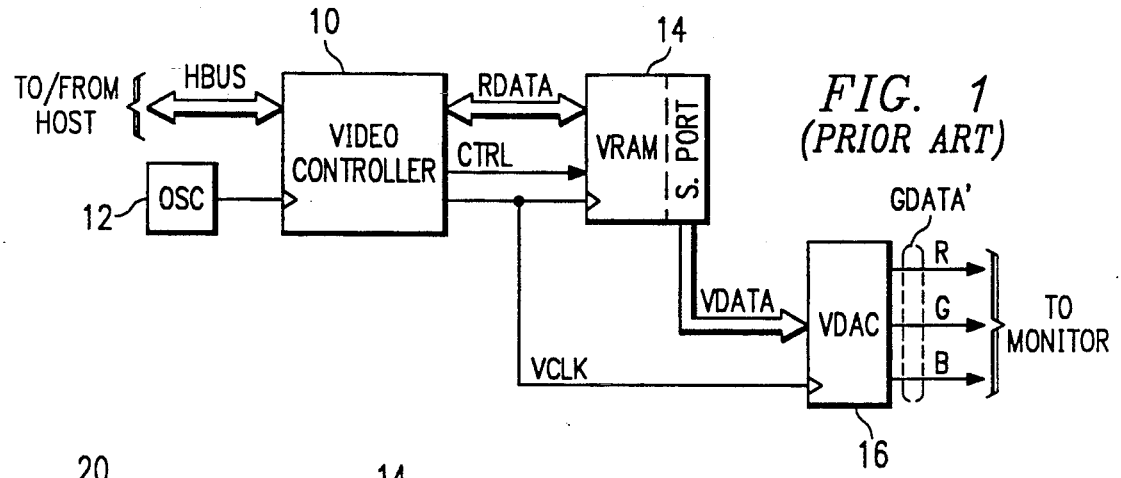
FIG. 1
(PRIOR ART)
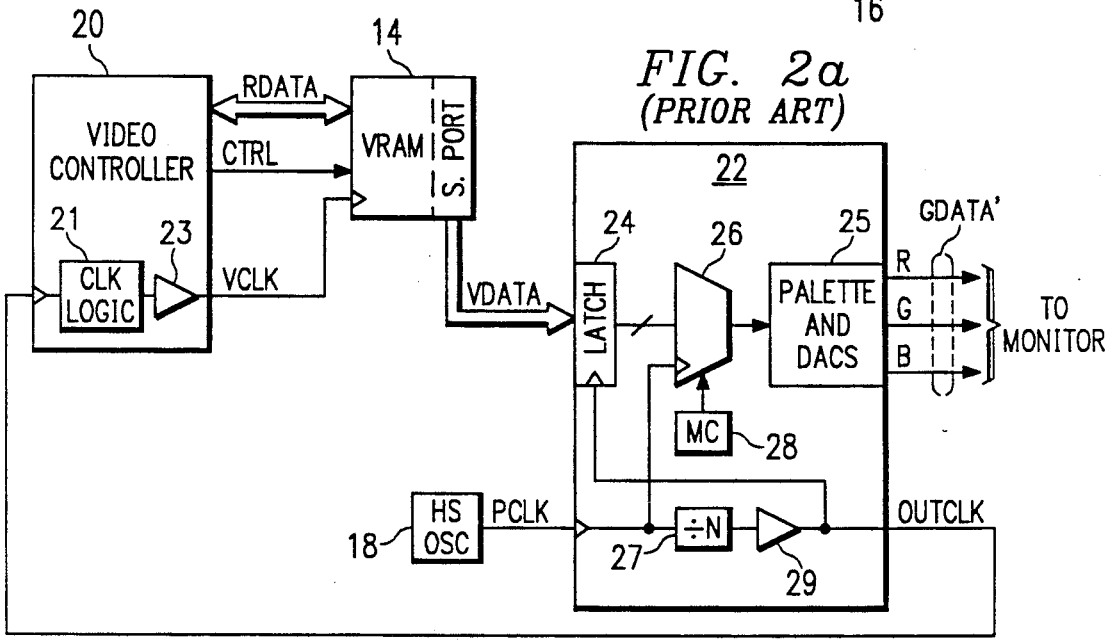
FIG. 2a
(PRIOR ART)
FIG. 2b
(PRIOR ART)
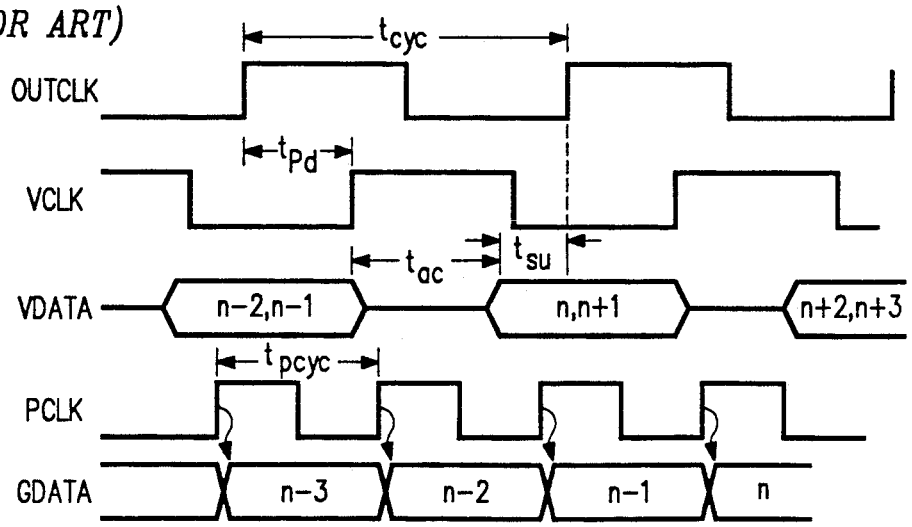

HIGH-SPEED VIDEO DISPLAY SYSTEM

This invention is in the field of data processing equipment, and is more specifically directed to circuitry for generating a video display image.

This application is related to application Ser. No. 696,355, filed contemporaneously herewith and assigned to Compaq Computer Corporation.

BACKGROUND OF THE INVENTION

High resolution video displays are becoming more prevalent for modern data processing systems such as personal computer workstations and the like. As is well known, video displays achieve such higher resolution by increasing the density of picture elements ("pixels") within the screen area. Higher pixel density correlates to smaller pixel sizes, such that the resolution of the displayed image is increased. In addition, more recent video displays are utilizing more colors possible for each pixel. As a result, the display output of the workstation may be more accurate and lifelike, presenting the output of the computer or workstation in more useful and illustrative forms to the user.

The frequency at which conventional cathode-ray tube (CRT) displays must be updated or refreshed has a lower limit, generally around 60 Hz, although some display devices are refreshed at even faster rates. Update or refresh at a lower frequency will cause the display to flicker, and cause a moving image to jitter; each of these effects are, of course, annoying to the user and distract from the quality of the image presented by the computer. Since the period of time over which the entire display output can be written is thus fixed, higher resolution displays require a shorter time for presentation of each pixel to the monitor. For example, a 256 by 256 pixel display, updated at 60 Hz, requires one pixel of data every 0.25 microseconds, i.e., a pixel data rate of 4 MHz. A modern high resolution display having 1024 by 768 pixels, refreshed at the same frequency of 60 Hz, requires a pixel of data every 21 nanoseconds (pixel data rate of 47 MHz). Of course, faster frame rates will further increase the required pixel data rate. As a result, a major challenge in the design of high resolution displays is to provide the necessary high speed data processing and communication circuitry to output the pixel data at the proper data rates.

Referring now to FIG. 1, a first graphics subsystem according to the prior art will be described. According to this conventional system, video controller 10 is in communication with a host processor, such as a microprocessor, by way of host bus HBUS. Host bus HBUS communicates data from the host processor, through video controller 10, to video frame memory (VRAM) 14; VRAM 14 stores the data to be displayed on the output monitor, generally in bit-mapped or other well-known forms. Video controller 10 may be a special purpose microprocessor for controlling access between the host processor and VRAM 14, and generally executes graphics instructions such as line draw, block transfer, and the like; an example of such a type of video controller 10 is the TMS 34020 graphics system controller manufactured and sold by Texas Instruments Incorporated. Many large volume computer manufacturers prefer to implement video controller 10 as a custom integrated circuit, such as an application-specific integrated circuit (ASIC), customizing the functionality and performance of the graphics subsystem.

Video controller 10 is in communication with VRAM 14 via bus RDATA and control lines CTRL, in the conventional manner, as shown in FIG. 1. Video controller 10 also presents a clock input VLCK to VRAM 14, for controlling the rate at which data is presented at the output of VRAM 14. In this embodiment of the invention, VRAM 14 is a system of multiple memory integrated circuits, preferably video DRAM devices as are readily available in densities up to at least 1 Mbit. As well known in the art, such video DRAM devices include both a random access port and an independent serial access port. According to the system of FIG. 1, the random access ports of the video DRAM devices in VRAM 14 are coupled to bus RDATA in communication with video controller 14, and the serial output ports of the video DRAM devices in VRAM system 14 are coupled to video digital-to-analog converter (VDAC) 16. Clock input VCLK controls the rate at which data is clocked from the serial output of VRAM 14 to VDAC 16.

VDAC 16 is a conventional video DAC, such as the Bt473 True Color RAMDAC or the Bt477 Power-Down RAMDAC, each manufactured and sold by Brooktree Corporation. Modern VDACs, such as the Bt477, include not only the digital-to-analog circuitry required to convert a digital data stream into analog signals for application to a CRT monitor (not shown), but also include some amount of graphics data processing capability. For example, many conventional VDACs include color palette memories, so that the data presented to its input need not be the actual RGB (red-green-blue) data for conversion, but instead may be an index from which the VDAC generates the color information and appropriate data for presentation. Referring to FIG. 1, the RGB outputs of VDAC 16 are shown as comprising bus GDATA', and carry analog signals corresponding to the intensity of each color to be applied to the monitor screen, in the conventional manner.

In the conventional system of FIG. 1, timing control of the display is based on oscillator 12, which presents a clock signal to video controller 10. In these prior art systems, video controller 10 performs its operations according to the output of oscillator 12, and drives clock signal VCLK at its output. Clock signal VCLK is applied both to the serial clock input of VRAM 14, and also to VDAC 16 to latch the pixel video data on bus VDATA into VDAC 16 for conversion into the RGB data in the conventional manner. However, it should be noted that since the clock signal used to clock out the video data passes through video controller 10, and is also used to clock VRAM 14, the pixel clock rate at which VDAC 16 receives and presents each pixel's data is limited to the cycle time of VRAM 14, which is on the order of 33 MHz for the fastest video DRAM devices. Accordingly, the display resolution controllable by this system is necessarily limited.

It should be noted that one prior technique for overcoming this limitation on the pixel clock rate is to provide an external multiplexing device for receiving multiple pixels' data from VRAM 14. In such a system, the output of the external multiplexer is clocked at the pixel clock rate to present each pixel at the desired rate. However, this solution is quite expensive and impractical in today's technology, particularly considering the load presented by adding integrated circuit chips in the highest speed data path.

In addition, since the clock signal used to control the serial data output from VDAC 16 is generated indirectly from oscillator 12 by video controller 10, variations in the propagation delay of this clock signal must be taken into account in the design. Particularly for large VRAM systems 14, such as those necessary to present large numbers of colors, or true color output (requiring twenty-four parallel graphics output bits), the load of the serial clock inputs of memory devices in VRAM 14 requires relatively large buffering of clock output VCLK in video controller 10, further increasing the delay therethrough and its variability.

Referring now to FIGS. 2*a* and 2*b*, a second conventional graphics subsystem will now be described. This system is theoretically applicable to higher resolution displays, because the frequency of the clock applied to the video DAC is greater than that applied to the video DRAM devices. As shown in FIG. 2*a*, the output of a high speed oscillator 18 is applied directly to the clock input of VDAC 22, and VDAC 22 will generate a lower frequency clock for controlling video controller 20 and accesses from VRAM 14.

The system of FIG. 2*a*, similarly as the system of FIG. 1, includes video controller 20 for communication with the host processor (not shown), and with the random access port of VRAM 14 by way of bus RDATA and control lines CTRL; video controller 20 also generates the clock signal VCLK which controls the data output from the serial port of VRAM 14, which is applied to VDAC 22.

In the system of FIG. 2*a*, however, VDAC 22 includes latch 24 and multiplexer 26, so that the serial port of VRAM 14 may receive data for multiple pixels at a time. An example of VDAC 22 in this prior system is the Bt474 Triple 8-Bit 85 MHz RAMDAC manufactured and sold by Brooktree Corporation. High speed oscillator 18, which generates the video output clock (pixel clock) signal PCLK, is connected directly to VDAC 22 (i.e., not via video controller 20). Pixel clock signal PCLK is connected to multiplexer controller 28 to control the multiplexing of the pixel data, and also to divide-by-N circuit 27 which, via buffer 29, generates output clock signal OUTCLK for application to video controller 20. Clock signal OUTCLK also is connected internally to latch 24, and controls the latching of data from bus VDATA into VDAC 22. Multiplexer controller 28 controls multiplexer 26 to select the proper bits of latch 24 for application to palette/DAC circuitry 25, which generates the appropriate RGB analog signals on analog bus GDATA' to the display device, for example a monitor.

Video controller 20 includes clock logic circuitry 21 and buffer 23, for generating clock signal VCLK at the proper frequency and phase, such that the serial output data from VRAM 14 is applied to VDAC 22 at the appropriate time.

As a result of this multiplexed configuration, the VRAM 14 cycle time does not directly limit the pixel clock cycle time, as in the case of the system of FIG. 1. For example, if bus VDATA carries two pixels' worth of data, pixel clock signal PCLK can be at twice the frequency of clock signal VCLK (i.e, N equals 2, in divide-by-N circuit 29). Multiplexer controller 28 will select first one pixel, then the other, on successive cycles of pixel clock signal PCLK, with data for the next two pixels appearing on bus VDATA for latching into latch 24 during this time.

The timing of the operation of the system of FIG. 2*a* is shown in FIG. 2*b*, and will now be described in detail, for a 2:1 multiplexed case. The period of clock signal OUTCLK is shown as $t_{cyc}$ in FIG. 2*b*, generated by divide-by-2 circuit 27 in VDAC 22 to be twice the period of pixel clock signal PCLK (shown as $t_{pcyc}$). Latch 24 in VDAC 22, in this example, latches in its data upon the rising edge of clock signal OUTCLK. Clock signal VCLK, generated by video controller 20 from clock signal OUTCLK, has the same frequency as clock signal OUTCLK but is delayed therefrom by the value $t_{pd}$, corresponding to the propagation delay through clock logic 21 and buffer 23 therein. Upon the rising edge of clock signal VCLK, followed by the serial port access time $t_{ac}$ of VRAM 14, VRAM 14 presents data at its serial output. As noted hereinabove, since this is a 2:1 multiplexed case (i.e., two pixels of data are read from VRAM 14 at a time, for display by VDAC 22 one-by-one), data for two pixels are presented on bus VDATA after the access time $t_{ac}$. In order that the data is accurately latched by latch 24 upon the rising edge of clock signal OUTCLK, the serial data on bus VDATA must be present a certain set-up time $t_{su}$ prior to the rising edge of clock signal OUTCLK.

In operation, as shown in FIG. 2*b*, the rising edge of clock signal OUTCLK latches two pixels of data (e.g., pixels n−2 and n−1) into latch 24. The next two rising edges of pixel clock signal PCLK cause the contents of the two latched pixels to be communicated (shown in FIG. 2*b* as digital signals GDATA) to DACs within VDAC 22 for presentation to the monitor as analog signals on analog bus GDATA'. During these two cycles of pixel clock signal PCLK, clock signal OUTCLK is communicated to video controller 20 for generation of clock signal VCLK, which is communicated to VRAM 14 for presentation of data for the next two pixels n, n+1.

In order for the system of FIGS. 2*a* and 2*b* to operate, the access of data from VRAM 14 must occur in time to be latched into latch 24 upon the next rising edge of clock signal OUTCLK. Referring to FIG. 2*b*, this requires the following relationship among the times shown therein:

$$t_{cyc} \geqq t_{pd} + t_{ac} + t_{su}$$

with $$N(t_{pcyc}) = t_{cyc}$$

For the example of FIG. 2*b* where N equals 2, and using typical times for $t_{pd}$ of 25 nsec, $t_{ac}$ of 25 nsec, and $t_{su}$ of 4 nsec, $t_{pcyc}$ must be 27 nsec or greater for proper operation. For 60 Hz display refresh, this limits the applicability of the system of FIG. 2*a* to a display no greater than 785 pixels on a side (where 2:1 multiplexing is used).

According to the above example, of course, greater multiplexing (e.g., 4:1 and 8:1) will allow the period of pixel clock signal PCLK to be much faster. However, the number of data bits presented for each pixel corresponds to the number of colors available for display (for an n-bit word, $2^n$ colors may be selected). Accordingly, for the system of FIG. 2*a*, high resolution display requires limiting the available color choices, increasing the width of the bus carrying the pixel data, or limiting the spatial resolution of the display system.

Furthermore, the highest color selection in modern graphics systems utilizes twenty-four bits of information per pixel. This "true color" mode provides eight intensity bits for each of the red, green and blue guns of an RGB monitor. For conventional data paths of thirty-two bits, this true color mode precludes multiplexing of pixel data on the bus, requiring a value of one for N in the above-described example. Given the examples of propagation time, access time and setup time above in the system of FIG. 2a, operation of the system in non-multiplexed mode limits the pixel clock period to 54 nsec or longer, further limiting the display resolution available.

It is therefore an object of this invention to provide a video display system capable of handling high data rates compatible with high resolution display monitors.

It is a further object of this invention to provide such a system which allows for selectable multiplexing schemes, including 1:1 multiplexing, providing selectable display resolution within the system timing requirements.

It is a further object of this invention to provide a video DAC useful in such a system.

It is a further object of this invention to provide such a system which allows for extremely wide pixel data words, such as necessary for "true" color display.

Other objects and advantages of the present invention will become apparent to those of ordinary skill in the art having reference to the following specification together with the claims.

SUMMARY OF THE INVENTION

The invention may be incorporated into a graphics sub-system including frame memory and a video digital-to-analog converter (VDAC). The VDAC includes a clock input terminal for receiving the output of a high speed oscillator, as a pixel clock signal. The pixel clock signal controls the application of each pixel's data to circuitry for generating the output to the display. A divide-down circuit is also provided in the VDAC to generate an output clock signal based on the pixel clock signal. The output clock signal controls the system video controller, which in turn controls the serial output of the frame memory. The VDAC also has a second clock input for receiving a clock input generated by the video controller, responsive to which pixel data from the frame memory is latched into the VDAC. Two-stage latching is provided within the VDAC, so that the pixel clock controls the application of the contents of the first latch to the VDAC output. Accordingly, the loading of data into the VDAC may be done independently from the clocking out of the data from the VDAC. The pixel clock frequency is therefore not limited by the propagation delay through the video controller, increasing the pixel display rate and enabling the driving of higher resolution displays.

BRIEF DESCRIPTION OF THE DRAWINGS

FIG. 1 is an electrical diagram, in block form, of a first graphics subsystem according to the prior art.

FIG. 2a is an electrical diagram, in block form, of a second graphics subsystem according to the prior art.

FIG. 2b is a timing diagram illustrating the operation of the prior art system of FIG. 2a.

DETAILED DESCRIPTION OF THE PREFERRED EMBODIMENT

Figure 3:
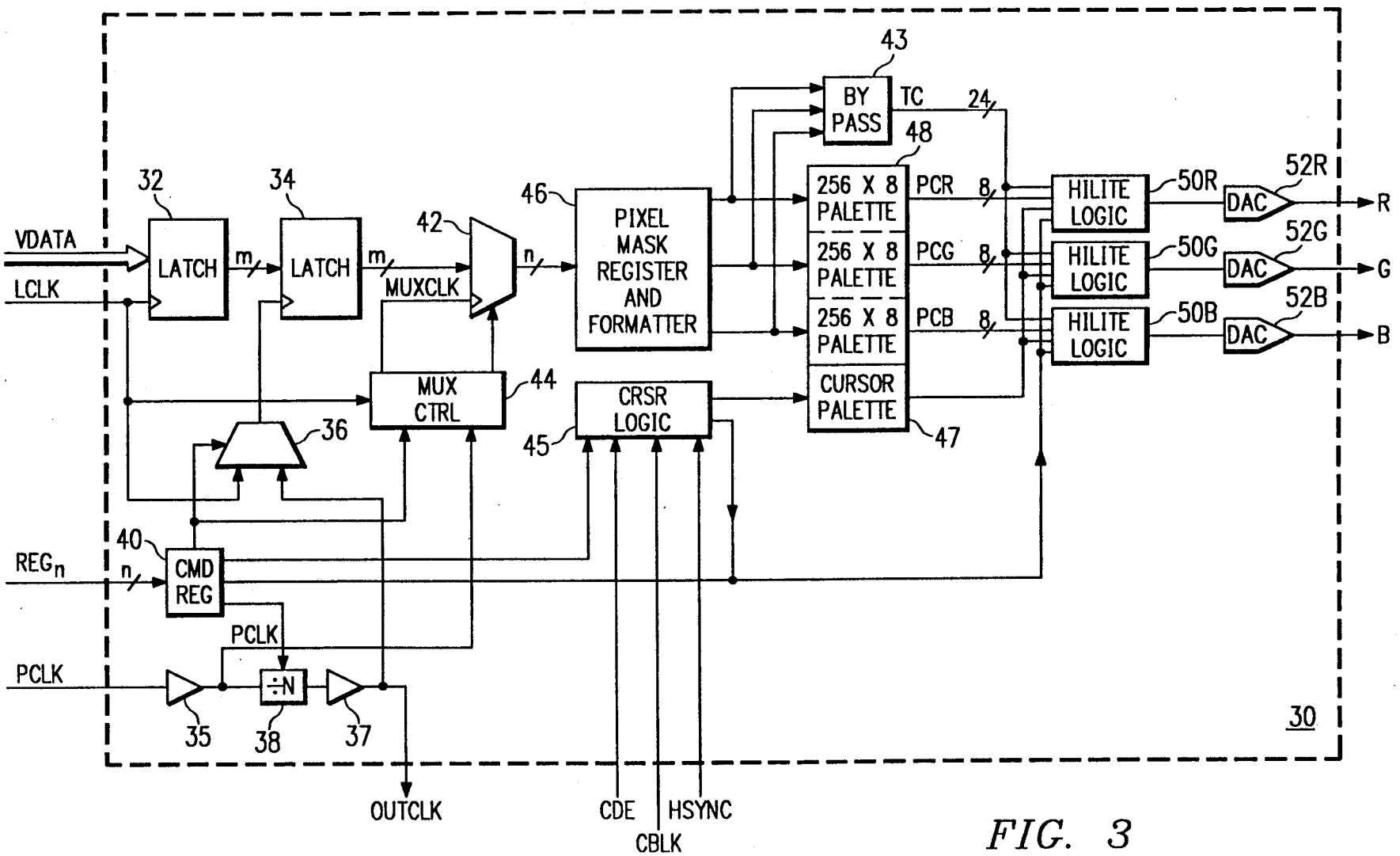
FIG. 3 is an electrical diagram, in block form, of a video DAC according to the present invention.

Referring now to FIG. 3, VDAC 30 according to the preferred embodiment of the invention will now be described in detail. VDAC 30 is a multiplexed video DAC, preferably formed as a single integrated circuit, and including color palette RAM, hardware cursor, and other functions useful in the generation of analog RGB signals corresponding to digital pixel data supplied thereto.

As will be apparent from the following description, according to this embodiment of the invention, the clocking of the input latch is performed independently from the multiplexing and output of video data according to the high-speed pixel clock signal. Due to this separate clocking, the pixel clock frequency is not limited by the propagation delay of the output clock signal OUTCLK elsewhere in the graphics subsystem. Higher speed system operation is thus achieved, so that higher density displays can be driven according to the present invention.

VDAC 30 includes first stage latch 32 having an input for receiving digital data from bus VDATA. Another terminal of VDAC 30 receives a clock signal LCLK from external to VDAC 30. Clock signal LCLK is received by first stage latch 32 to control the latching of data therein. As in the prior systems discussed hereinabove, bus VDATA communicates pixel data from frame memory to the display driver; in this example, bus VDATA includes at least thirty-two lines upon which thirty-two bits of graphics data are communicated to VDAC 30. As will be described in detail hereinbelow, these thirty-two bits can represent eight, four, two or one pixel for display, depending upon the number of colors desired. It should also be noted that, for systems such as the well-known VGA configuration, eight additional lines may be provided in bus VDATA for display in so-called "VGA" mode; if such is the case, a port select signal may also be presented to first stage latch 32 for selection of the "port" corresponding to the thirty-two pixel data lines or the eight-line VGA text port.

Pixel clock signal PCLK is also received at a terminal of VDAC 30 from an off-chip clock source, such as a phase-locked loop or oscillator, and is coupled to divide-by-N circuit 38 via buffer 35. Divide-by-N circuit 38 is controlled by command register 40 to set the multiple N by which the frequency of pixel clock signal PCLK is to be divided. In this example, N may be selected from the values 1, 2, 4, or 8, corresponding to the level of multiplexing in VDAC 30 (i.e., the number of pixels received at a time from bus VDATA). Buffer 37 receives the output of divide-by-N circuit 38, and drives clock signal OUTCLK at a terminal of VDAC 30.

According to this embodiment of the invention, and as will be described hereinbelow relative to the operation of VDAC 30, the clock signal received at LCLK controls the receipt of pixel data by VDAC 30 (in first stage latch 32), rather than the output clock signal OUTCLK controlling such receipt as used in prior conventional VDACs. As described hereinabove, the use of the output clock signal OUTCLK to latch video data into the VDAC required that the propagation delay, access time and setup time all occur within one cycle of the output clock signal OUTCLK, which limited the video data rate through the VDAC. This limitation is overcome by the present invention.

High speed pixel clock signal PCLK controls the application of the pixel data to the "back-end" processing of VDAC 30, including the digital-to-analog conversion for driving the display device. For proper operation, however, synchronization of the pixel data received by VDAC 30 to the pixel clock signal PCLK is necessary. In this example, such synchronization is implemented by way of second stage latch 34, having an input coupled to the output of first stage latch 32 in a master-slave configuration (latch 32 being the master and latch 34 the slave). The clocking of data into second stage latch 34 is controlled by clock multiplexer 36, in this example, due to the different operating modes desired for VDAC 30. Clock multiplexer 36 receives pixel clock signal PCLK at one input and output clock signal OUTCLK at a second input. Clock multiplexer 36 selects either clock signal LCLK or clock signal OUTCLK for application to the clock input of second stage latch 34, under control of command registers 40, according to the multiplexing mode selected for VDAC 30.

Command registers 40 are loaded by signals on bus REGn, presented by a video controller or other circuit in the system. The contents of command registers 40 control the selection of 8:1, 4:1, 2:1, or 1:1 multiplexing, as well as other modes of operation for VDAC 30 including hardware cursor mode selection and control. The various multiplexing modes selectable for VDAC 30 allow it to drive display devices of various sizes and resolution by selecting the desired mode. As a result, neither substitution of a different video DAC nor reconfiguration of the system hardware is necessary to efficiently drive different displays. In this embodiment, the multiple of the pixel clock PCLK frequency which is applied to the second stage latch 36 is selected by command registers 40 corresponds to the desired level of multiplexing.

The output of second stage latch 34 is connected to the input of multiplexer 42. Multiplexer 42 is controlled by multiplexer control circuit 44, which receives information indicative of the level of multiplexing desired from command registers 40. Multiplexer control circuit 44 also receives pixel clock signal PCLK after buffering by buffer 35, and applies it to multiplexer 42 via line MUXCLK, phase shifted by a desired amount consistent with delay through latches 32 and 34, as necessary. Multiplexer control circuit 42 also receives latch clock signal LCLK at an input, which it will apply to line MUXCLK in non-multiplexed mode, as will be described hereinbelow. Multiplexer 42 provides j bits at its output, j being determined by the multiplexing level desired, and indicated by command registers 40 and multiplexer control circuit 44. In this embodiment of the invention, where 8:1, 4:1, 2:1, and 1:1 multiplexing is available, j may equal 4, 8, 16 or 24 bits (24 being sufficient for "true color" output for a pixel and selected in non-multiplexed mode).

It should be noted that the above-described arrangement of master-slave latches 32, 34 is only one contemplated implementation of circuitry for synchronizing the pixel data to the pixel clock signal PCLK. Such synchronization may also be implemented with a single latch stage 32, by inserting a fixed phase relationship between pixel clock signal PCLK (as applied to multiplexer 42 on line MUXCLK) relative to clock signal LCLK (i.e., relative to the output clock signal OUTCLK generated from pixel clock signal PCLK). Proper timing between latch clock signal LCLK and multiplexer clock MUXCLK, when based on pixel clock signal PCLK, will allow such synchronization without requiring two latches. Further in the alternative, a FIFO buffer may alternatively be used, with the input of such a buffer coupled to the output of first stage latch 32, and with its contents shifted according to pixel clock signal PCLK. It is now contemplated that other synchronization circuits and techniques for accomplishing this function will now also be apparent to those of ordinary skill in the art having reference to this description.

The output of multiplexer 42 is applied to the input of processor 46. Processor 46 includes such conventional functions as a pixel mask register for masking pixel data in the conventional fashion; in addition, processor 46 can provide a formatting function, either by way of a look-up table or by logical operation, to receive the pixel data from multiplexer 42 for proper application to color palette RAM 48, the input of which receives the output of processor 46. Processor 46 may, in addition, be capable of performing graphics operations on the data that it receives from multiplexer 42, such operations including color processing.

In conventional display systems, the data communicated from the frame memory for a pixel is generally a color index. This color index corresponds to an address in color palette RAM 48, which serves as a color look-up table. In this embodiment of the invention, color palette RAM 48 stores 256 displayable color combinations, each being twenty-four bits wide. Color palette RAM 48 generates the twenty-four bit output addressed by the color index presented to its input. Eight bits of the twenty-four bit output correspond to the desired intensity for the red portion of the RGB analog output, eight bits for green, and eight bits for blue. The combination of the intensities for the three "guns" of the RGB monitor corresponds to the desired display color. In VDAC 30 according to this embodiment of the invention, the three sets of eight-bit outputs from color palette RAM 48 are applied to eight-bit inputs of highlight logic 50R, 50G, 50B, respectively.

For communication of true color information in non-multiplexed mode, where up to twenty-four bits are used for each pixel, the communicated from multiplexer 42 to color palette RAM 48 are grouped according to the display components driven by VDAC 30, and correspond to the intensity level of each component to be driven to the display device. In this example where the display device is a CRT, driven by RGB (red-green-blue) components, twenty-four bits from multiplexer 42 include eight intensity bits for the red component, eight intensity bits for the green component, and eight intensity bits for the blue component. As a result, the data communicated for each pixel is not limited to the 256 colors in color palette RAM 48, but directly communicates the eight-bit digital value corresponding to the intensities of the red, green and blue guns of the monitor. Accordingly, each gun can receive 256 intensity values from the frame memory, thus allowing generation of $256^3$, or 16,777,216 possible colors from the twenty-four bits of information. Alternatively, fewer bits (for example sixteen bits, grouped as five-six-five for the three color components) may be used to communicate the intensity of each component to be driven to the display device.

It should be noted that this true color data could be communicated directly to DACs 52, so that the analog intensity output therefrom would be a direct digital-to-analog conversion of the pixel data from frame memory 14. Color palette RAM 48 preferably assists in the accuracy of the displayed color, however, by providing a look-up function for each of the three components of pixel data it receives. According to this preferred embodiment, as shown in FIG. 3, color palette RAM 48 is segmented into three 256 by 8 portions, and includes three address decoders, each independently operating on a group of bits from multiplexer 42 in the true color mode. The segmented contents provide an output for each component (e.g., RGB) which corresponds to an intensity value designated by the pixel data presented thereto in the associated group of input bits. Use of the color palette RAM 48 in this mode allows for adjustment of the linearity of the analog output generated by each digital value; this adjustment may be done considering the responsive of a particular display device to be driven by VDAC 30, or according to other characteristics of the system.

It should also be noted that a portion, or mode, of color palette RAM is also preferably available by which it considers the output of processor 46 not as three separate eight-bit addresses, but considers it as a twenty-four bit address. In this mode, controlled for example by control registers 40, color palette RAM 48 operates as a 256 by 24 memory device, rather than as a set of three 256 by 8 memory segments. It is contemplated that a designer of ordinary skill in the art will be able to readily construct such a segmented memory, based on this specification.

There is also a need to communicate pixel data directly to DACs 52 without correction by color palette RAM 48. Accordingly, VDAC 30 further includes bypass logic 43 which, under control of command registers 40, couples the output of processor 46 to highlight logic 50 when an alternative display mode is selected, for example a VGA display mode, or other modes in which use of color palette RAM 48 is not desired. When enabled, bypass logic 43 communicates the output of processor 46 to the three sets of eight-bit inputs to highlight logic 50R, 50G, 50B.

Highlight logic 50R, 50G, 50R, have eight-bit outputs connected to the inputs of digital-to-analog converters (DACs) 52R, 52G, 52B, respectively. DACs 52R, 52G, 52B generate analog values corresponding to the digital value at their inputs in conventional DAC fashion; these analog values are communicated to the system monitor, and drive the corresponding red, green and blue electron guns in the monitor. While the present invention is described for conventional RGB display systems, other types of monitors and display systems may also benefit from the present invention.

VDAC 30 also includes both a conventional hardware cursor function, as well as a highlight mode function according to the preferred embodiment of the invention. As is well known, a cursor is a block of pixels, for example thirty-two pixels on a side in a high density display, which contrasts with and is displayed instead of the graphical output at a location of the screen, for example corresponding to a location at which a user input is requested. The displayed cursor may consist of the entire pixel block contrasting with the surroundings, such that a rectangular block appears at the pixel location. Alternatively, the cursor may be a character or other displayed image which is contained within the cursor block, for example an arrow or other icon, with bits outside of the cursor image within the cursor block appearing as though the cursor were not present. Timing features may also be included in cursor generation, for example by causing the cursor to blink on the display, further contrasting it with the surroundings.

As illustrated in FIG. 3, VDAC 30 includes certain elements which are conventional for generation of a cursor. These elements include cursor color RAM 47, selectable by way of cursor logic 45 under control of command registers 40. Cursor logic 45 includes a cursor image RAM which communicates a cursor color selection to cursor color RAM 47 at times corresponding to the pixel within the cursor block. Cursor color RAM 47 in turn presents the selected cursor color on the twenty-four output lines coupled to highlight logic 50 for application to DACs 52.

Other prior cursor display systems perform an exclusive-OR function between a cursor on value ("1") and the video data; in these prior display systems, however, the exclusive-OR function is done on the color index value, i.e., the input to color palette RAM 48. Because this prior arrangement results in a cursor color index value which is the logical complement of the non-cursor value, the contrast in colors depends upon the arrangement of colors in the color palette RAM, particularly the difference in colors having complementary index values. If similar colors have complementary index values, the displayed cursor may not significantly contrast with the surrounding color, and have poor visibility relative to its surroundings.

According to the present invention, however, a highlight cursor mode may be selected by a value loaded into command registers 40. In this mode, for those pixels within the cursor area which are to be "highlighted", the output from color palette RAM 48, or from bypass logic 43, depending on the mode, is logically inverted prior to application to DACs 52. As a result, it is much more likely that the displayed cursor will significantly contrast with the color which would otherwise be displayed (and thus with the surrounding colors, as it is likely that the surrounding colors are similar), than in prior cursor highlight implementations where the color index value was inverted to highlight pixels in the cursor.

Figure 6:
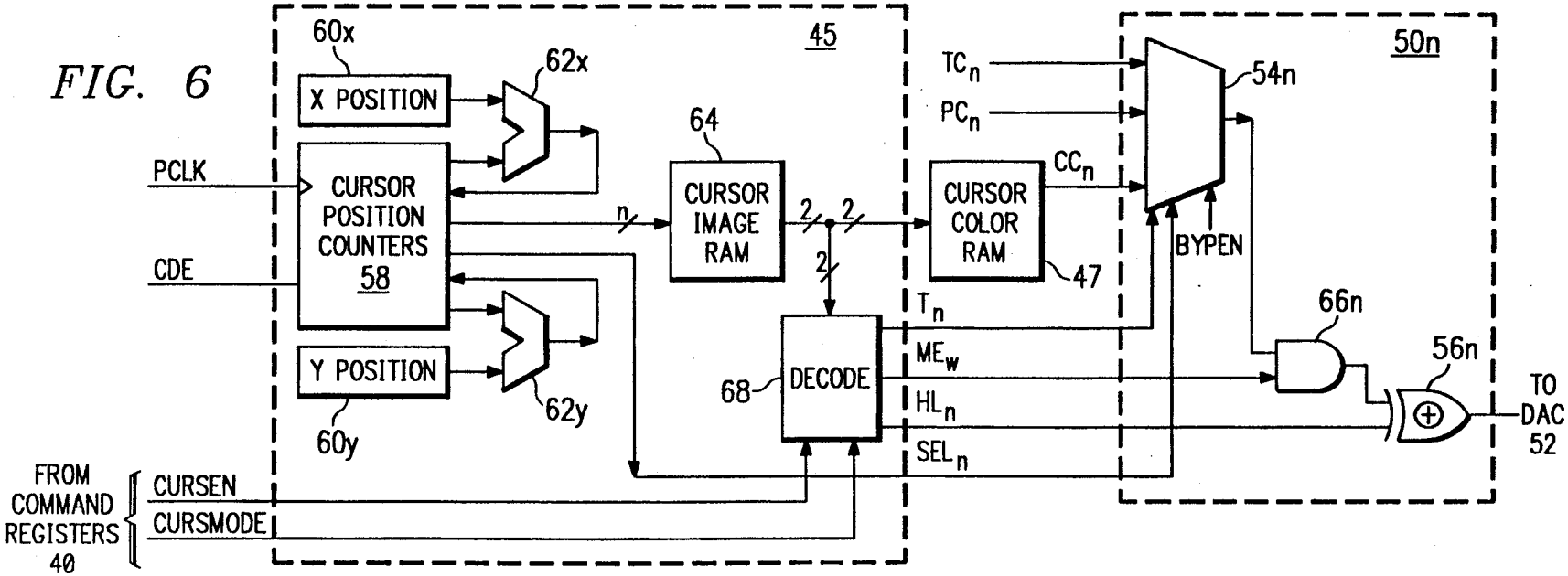
FIG. 6 is an electrical diagram, in block schematic form, of the cursor logic in the video DAC of FIG. 3.

According to the present invention, VDAC 30 includes a highlight mode, generated by highlight logic 50R, 50G, 50B, which ensures that the cursor color contrasts as much as possible with the color it is replacing in the display. Referring now to FIG. 6, highlight logic **50*n* for one bit will be described in detail in combination with cursor logic 45**.

Cursor logic 45 includes cursor image RAM 64, as noted hereinabove. Cursor image RAM 64 includes an addressable location for each pixel within the desired cursor block. For example, if the size of the displayed cursor block is 32 pixels by 32 pixels, cursor image RAM will have $32^2$ addressable locations. Each addressable location in cursor image RAM 64 consists of a digital code corresponding to the image to be displayed for that pixel. For example, for simple cursor generation schemes, cursor image RAM 45 would have one bit of storage for each address, with the value of the bit corresponding to "on" or "off" for that pixel in the cursor. In the present embodiment, cursor image RAM 64 is 32 by 32 by 2, with four modes selectable for each pixel in the cursor block; these four modes are "color 1", "color 2", "transparent" and "highlight", which will be described hereinbelow.

Cursor logic 45 further includes X and Y position registers 60x and 60y, respectively, for storing the X and Y coordinates of the desired position of the cursor in the displayed image. As will be noted hereinbelow, the stored value in registers 60 will be one corner of the cursor image, for example the lower right hand corner. Cursor logic 45 further includes cursor position counters 58, having both X and Y components therein, for keeping track of the current pixel position being displayed. Cursor position counters 58 receive a reset signal on line CDE which, as is well known, is the composite display enable signal indicating the beginning of the display area, and also receive pixel clock signal PCLK for incrementing its contents for each pixel displayed.

Comparators 62x, 62y are also located within cursor logic 45, for comparing the contents of cursor position counters 58 with the values stored in X and Y position registers 60x and 60y. The output of comparators 62x, 62y is communicated to cursor position counters 58. The output of cursor position counters 58 is an address value communicated to cursor image RAM 64, presenting either an address which corresponds to a null value when the current pixel being displayed is outside of the cursor block, or which corresponds to the position of the current pixel within the pixel block when such is the case. Cursor position counters 58 also present a control signal on line SELn to highlight logic 50, for controlling the selection of a cursor color data for pixels located within the cursor block, as will be further noted hereinbelow.

Cursor image RAM 64, in this example, presents a two-bit value (RAM 64 having two bits per address) to cursor color, or palette, RAM 47, and to decode 68. As noted hereinabove, the contents of cursor image RAM 64 indicates the desired display mode for a pixel in the cursor block. Two of the modes available in this example of the invention correspond to two pre-assigned colors, color 1 and color 2. Cursor palette RAM 47 is thus addressable by the output of cursor image RAM 45 to present the selected color (color 1 or color 2) to highlight logic 50.

Decode 68 also receives the output of cursor image RAM 64, and controls the transparent and highlight modes according to this embodiment of the invention. Decode 68 receives signals on lines CURSEN and CURSMODE from command registers 40, indicating whether the cursor function is to be enabled, and the modes available for display of the cursor; command registers 40 thus can disable the generation of any cursor (or particular cursor modes) by these signals. Decode 68, in this example, presents control signals to highlight logic 50 on lines ME and HL.

Referring still to FIG. 6, a single bit 50n of highlight logic 50 is illustrated; it is of course understood that each of the twenty-four bits of highlight logic 50 will be similarly constructed. Included within highlight logic 50n is multiplexer 54n, which receives line TCn from bypass logic 43, line PCn from color palette RAM 48, and line CCn from cursor color RAM 47. Multiplexer 54n also receives control inputs on line SELn from decode 68 in cursor logic 45, and on line BYPEN from command registers 40. In addition, decode 68 generates a line Tn, for transparent mode, which is also connected to a control input of multiplexer 54n so that, in a cursor location when transparent or highlight cursor pixels are to be displayed, multiplexer 54n will not select line CCn. Multiplexer 54n is thus able to select one of the three inputs for application to its output, dependent upon whether or not bypass logic 43 is enabled, and depending upon whether or not the current pixel is within the cursor block, or is to be transparent or highlighted.

The output of multiplexer 54n is coupled to an input of AND gate 66n, which receives line MEn from decode 68 in cursor logic 45. The output of AND gate 66n is coupled to a first input of exclusive-OR gate 56n, which receives line HLn from decode 68 at its other input. The output of exclusive-OR 56n is connected to its associated DAC 52.

Figure 7:
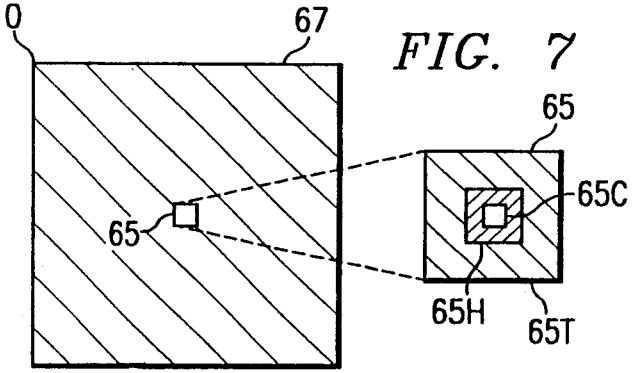
FIG. 7 is a representation of the display driven by the system of FIG. 4, including the position of a cursor therein.

The operation of cursor logic 45 and highlight logic bit 50n will now be described relative to FIG. 7. FIG. 7 illustrates display area 67, having its origin 0 in the upper left-hand corner; for purposes of this example, it is assumed that the entire display area 67 is of the same color. Cursor block 65 is illustrated as near the center of the display area in this example. For purposes of description, this example of the desired image for cursor block 65 is an area 65C of "color 1" at its center, surrounded by a highlighted area 65H, further surrounded by a "transparent" area 65T, in which the color which would otherwise be displayed will appear (the cursor being transparent in area 65T).

In operation, display area 67 will be generated for each pixel outside of cursor 65, by color palette RAM 48 presenting the display color to highlight logic 50 on lines PCn (as shown in FIG. 6), beginning from origin 0 when line CDE resets the values in cursor position counters 58. Prior to this time, the desired cursor position values have been loaded into cursor position registers 60x, 60y. As the display data is generated, so long as the pixel position is outside of cursor 65, the result of comparators 62x, 62y will indicate the same to cursor position counters 58. The null value will be communicated to cursor image RAM 64, and accordingly to decode 68. In addition, line SELn will indicate to multiplexer 54n to not select line CCn for output; either line PCn from color palette RAM 48 or line TCn from bypass logic 43 will be applied to the output of multiplexer 54n for these locations, depending upon the state of line BYPEN. For pixels outside of cursor 65, decode 68 will also drive line MEn high and line HLn low, so that the output of multiplexer 54n is communicated to DAC 52.

As display area 67 is scanned, pixel clock signal PCLK increments cursor position counters 58 until such time as cursor 65 is reached, and indicated by comparators 62x, 62y. Cursor position counters 58 will then present an address value to cursor image RAM 64, within which is stored the image shown in the blown-up portion of FIG. 7.

For those pixels within color area 65C, the output of cursor image RAM 64 will communicate the value to cursor palette RAM 47 which will address color 1 for application on line CCn to multiplexer 54n. Cursor position counters 58 will also indicate to multiplexer 54n, by way of line SELn, that line CCn is to be selected for application to its output, and to AND gate 66. This result will also cause decode 68 to drive line MEn high and line HLn low, so that the output of multiplexer 54n, which is cursor color 1 data on line CCn, is to be applied to DAC 52 for pixels in area 65C. It should be noted that other pre-assigned cursor colors will be similarly generated.

For pixels within transparent area 65T, however, the output of cursor image RAM 64 will present a code which causes decode 68 to indicate on line Tn that a transparent pixel is to be generated. Line Tn will override the state of line SELn from cursor position counters 58, and cause the otherwise selected line PCn or TCn to be applied to the output of multiplexer 54*n*, as though the pixel were not within cursor 65. Lines MEn and HLn are held high and low, respectively, so that the state of the output of multiplexer 54*n* will be communicated directly to DAC 52.

Within highlighted area 65H according to the invention, cursor image RAM 64 will indicate to decode 68 that the highlight function is to be applied. In this mode, decode 68 will drive line Tn to multiplexer 54*n* so that the otherwise selected line PCn or TCn is applied to the output of multiplexer 54*n*, as though the pixel were not within cursor 65. In addition, decode 68 will drive both lines MEn and HLn to high states. This will cause the output of multiplexer 54*n* to be applied to exclusive-OR gate 56*n*, but will cause exclusive-OR gate 56*n* to invert the value of multiplexer 54*n* prior to its application to DAC 52. As a result, for pixels in area 65H, the color displayed will be generated from DACs 52 from the logical complement of the color that would otherwise be displayed were the pixel not within cursor 65.

According to this embodiment of the invention, the exclusive-OR function of highlight logic 50, controlled according to the comparison of the display location to the desired cursor location and the desired cursor image, presents the logical complement of the digital color value as the cursor color, rather than the logical complement of the color index value as used in conventional video DACs and systems. The cursor contrast according to the present invention is therefore improved over a larger set of colors, and is not dependent upon the organization of colors within color palette RAM 48, according to this embodiment of the invention.

Referring still to FIG. 6, it should be noted that other cursor modes are available. For example, decode 68 may drive line MEn low, forcing the output of AND gate 66*n* low regardless of the output of multiplexer 54*n*. The state of line HLn will then determine whether a "1" or a "0" is applied to DAC 52 for that bit. As a result, a forced color (e.g., pure white, or pure black) can be generated for pixels in the cursor, without requiring the color to be stored in cursor palette 47.

Figure 4:
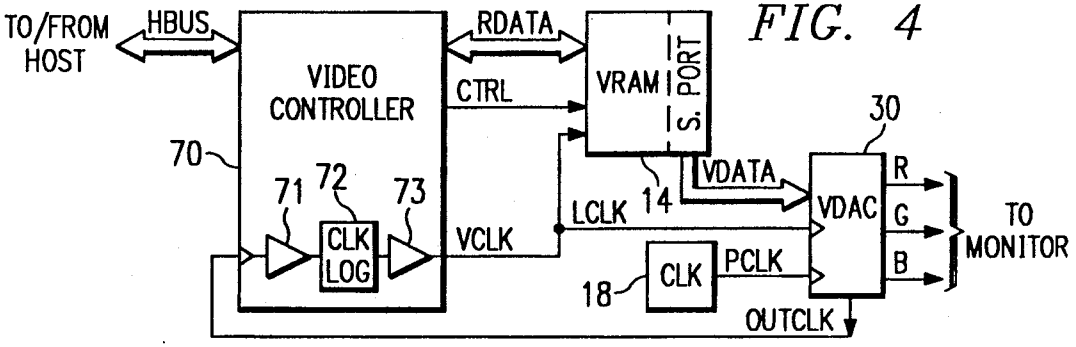
FIG. 4 is an electrical diagram, in block form, of a system according to the present invention including the video DAC of FIG. 3.

Referring now to FIG. 4, the implementation of VDAC 30 into a graphics subsystem, and its operation in connection therewith, will now be described. Similarly as in the prior conventional cases described hereinabove relative to FIGS. 1 and 2*a*, the system includes a video controller 70 which is connected via host bus HBUS to a host processor (not shown). Video controller 70 is also connected to VRAM 14 via random access bus RDATA and control lines CTRL, for controlling access to and refresh of VRAM 14. Also as in the prior cases, VRAM 14 is a dual-port memory subsystem, preferably including multiple video DRAM devices, each having a random access port for communication via bus RDATA to video controller 70, and also a serial access port for output of data to VDAC 30 on bus VDATA. The serial output from VRAM 14 is controlled by clock signal VCLK generated by video controller 70.

Video controller 70 may be a microprocessor, including graphics-specific microprocessors such as the TMS 34020 manufactured and sold by Texas Instruments Incorporated. Alternatively, and preferably for many high volume graphics subsystems, video controller 70 may be a custom integrated circuit, such as an ASIC, constructed to perform the particular graphics functions and operations desired. Via buffer 71, clock logic 72 in video controller 70 receives a output clock signal OUTCLK from VDAC 30, generates clock signal VCLK for application to VRAM 14 and clock signal LCLK for application to VDAC 30, both driven by buffer 73. As noted above, clock signal VCLK controls the output of serial data from the serial port of VRAM 14. Clock logic 72 includes the necessary and desired delay and other circuitry for generating clock signal LCLK at the appropriate phase delay from clock signal OUTCLK for system optimization. In this example, clock signals LCLK and VCLK are phase synchronous since they are generated at the same terminal of video controller 70; clock signals LCLK and VCLK may be alternatively be separately generated from clock signal OUTCLK, and may have a phase difference.

In this example, clock signal LCLK is also connected to the LCLK input of VDAC 30 which, as shown in FIG. 3, controls the latching of data from bus VDATA into first stage latch 32 of VDAC 30. Also as noted hereinabove, clock source 18 (for example, a PLL or oscillator) provides pixel clock signal PCLK to VDAC 30; pixel clock signal PCLK is at the frequency at which pixels of data are to be applied to the monitor receiving the analog output of VDAC 30. This frequency depends upon the refresh rate of the monitor (e.g., 60 Hz), and the display size in number of pixels. For example, if the display size is 1024 by 768 pixels, the frequency of pixel clock signal PCLK must be at least 47 MHz in order for each pixel to be displayed within the refresh time. It is contemplated that the present invention will be applicable to pixel clock signal PCLK frequencies at least as high as 80 to 100 MHz.

Figure 5A:
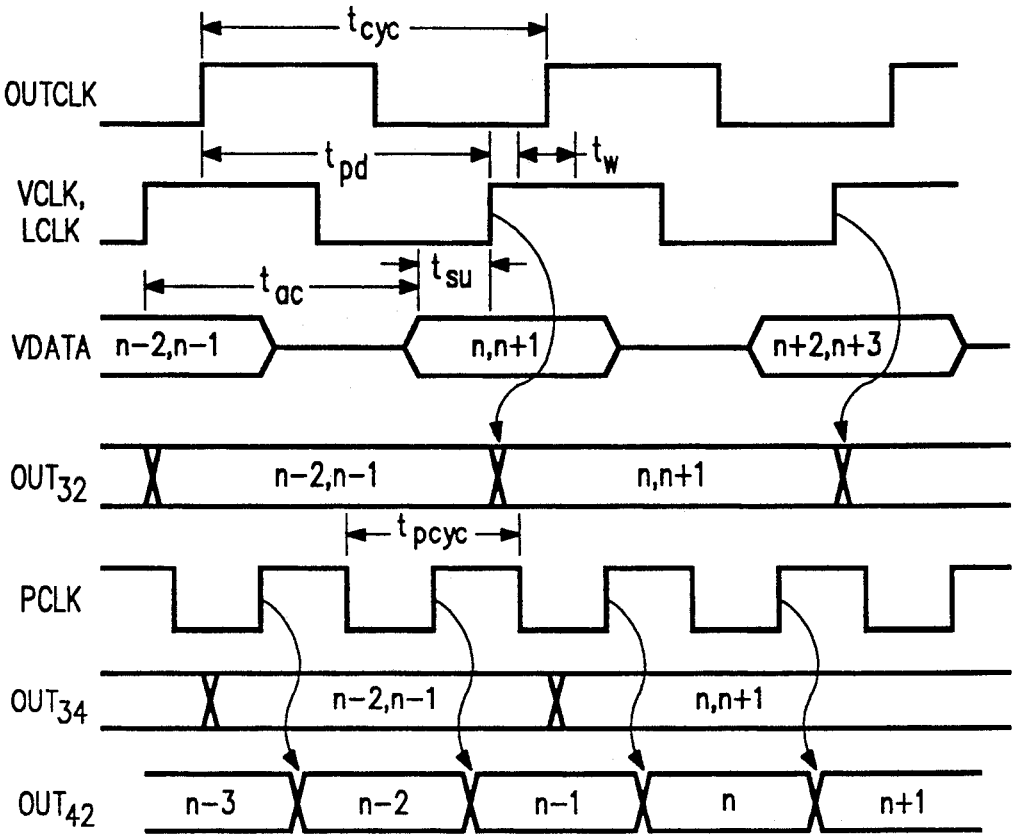
FIGS. 5a and 5b are timing diagrams illustrating the operation of the system of FIG. 4 in multiplexed mode and non-multiplexed mode, respectively.

Referring now to FIG. 5*a*, the operation of VDAC 30 in the system of FIG. 4 will now be described in detail, relative to a 2:1 multiplexed mode. As noted hereinabove, the multiplexing modes available in VDAC 30 according to this embodiment of the invention include 8:1, 4:1, 2:1, and 1:1 (or non-multiplexed mode); for ease of description, the 2:1 multiplexed mode will be described relative to FIG. 5*a*.

Pixel clock signal PCLK from high speed oscillator 18 is applied to divide-by-N circuit 38 to produce output clock signal OUTCLK. In this example of the 2:1 multiplexing mode, command register 40 contains the appropriate code for 2:1 multiplexing, and controls divide-by-N circuit 38 to produce clock signal OUTCLK at twice the period of pixel clock signal PCLK (i.e., N equals 2). It should be noted that, according to the present invention, the phase relationship between pixel clock signal PCLK and clock signal OUTCLK is not important.

Clock signal OUTCLK is communicated to video processor 70 which, via buffers 71, 73 and clock logic 72, generates clock signals VCLK for application to VRAM 14, and LCLK for application to VDAC 30. As noted hereinabove, clock signal VCLK controls the serial port of VRAM 14 and, accordingly, a serial access of VRAM 14 commences upon each rising edge of clock signal VCLK. After the access time $t_{ac}$ from the rising edge of clock signal VCLK, data will be presented on bus VDATA from the serial port of VRAM 14.

According to this example, clock signals VCLK and LCLK are generated at the same terminal of video processor 70, and hence not only have the same frequency as one another (and as output clock signal OUTCLK from which they are generated), but are also phase synchronous with one another (with neither one phase synchronous with output clock signal OUTCLK). As noted hereinabove, it is not necessary for clock signals VCLK and LCLK to be phase synchronous, but use of the same output terminal of video processor 70 is preferred for convenience. Common clock signals VCLK and LCLK require, however, that access time $t_{ac}$ from VRAM 14 is short enough that data is presented on bus VDATA prior to the necessary setup time $t_{su}$ before the next rising edge of clock signal LCLK, as this rising edge latches the data on bus VDATA into first stage latch 32 of VDAC 30. Of course, if the access time $t_{ac}$ is not that fast, generation by video processor 70 of a separate clock signal LCLK, delayed in phase from clock signal VCLK, would allow for proper operation of the system.

As noted hereinabove, the rising edge of clock signal LCLK latches the video data on bus VDATA from VRAM 14 into latch 32 of VDAC 30. After a short propagation delay, the latched data appears at the output of first stage latch 32, shown as line $OUT_{32}$ in FIG. 5*a*. Referring to FIG. 5*a*, such operation is evident where pixels n, n+1 are accessed from the first rising edge of clock signal VCLK, and appear at least as early as access time $t_{ac}$ thereafter. The next rising edge of clock signal LCLK after this access latches data for pixels n, n+1 into first stage latch 32, and presents the data at the output of first stage latch 32 (line $OUT_{32}$) after a short propagation delay.

Command registers 40 contain the code to enable 2:1 multiplexing in VDAC 30 in this example, and thus communicate to clock multiplexer 36 that clock signal OUTCLK is to control the latching of second stage latch 34 (instead of clock signal LCLK as will be used in the non-multiplexed mode described hereinbelow). Accordingly, upon the next rising edge of clock signal OUTCLK, second stage latch 34 receives and stores the output of first stage latch 32, and presents this data at its output after propagation through second stage latch 34. FIG. 5*a* illustrates this latching by line $OUT_{34}$ presenting pixels n, n+1 shortly after the first rising edge of clock signal OUTCLK after data for pixels n, n+1 has appeared at line $OUT_{32}$.

As noted hereinabove, the synchronization of the pixel data received by VDAC 30 and latched into first stage latch 32 is accomplished by way of the master-slave configuration of first and second stage latches 32, 34. Using this latch configuration, proper control of the phase relationship between clock signals OUTCLK and LCLK is important to ensure proper operation during multiplexed mode. This is due to the requirement that the data at the output of first stage latch 32 must be stable prior to the next rising edge of clock signal OUTCLK (as applied to second stage latch 34), which latches this data into second stage latch 34. Accordingly, setup and hold times of the data at the output of first stage latch 32 relative to the rising edge of clock signal OUTCLK must be obeyed for reliable operation. Referring to FIG. 5*a*, this is illustrated by time window $t_w$ on either side of the rising edge of clock signal OUTCLK, during which no transition of clock signal LCLK is allowed. Since in this case the rising edge of clock signal LCLK precedes time window $t_w$, the data for pixels n, n+1 is safely at the input of second stage latch 34 prior to the rising edge of clock signal OUTCLK.

It should be noted that this timing window will not be a significant limitation in the design and operation of VDAC 30, and thus the relatively easy implementation of second stage latch 34 to achieve synchronization is preferred in this embodiment. Alternative synchronization techniques, such as controlling the internal phase relationship between the high speed pixel clock signal and the latch clock signal, will not present this limitation on the system timing, and may thus be advantageous in some cases.

Command registers 40 also control multiplexer control circuit 44 to cause multiplexer 42 to select the appropriate bits at its input for application at its output. In the 2:1 multiplexing mode, with thirty-two bits presented at the output of second stage latch 34, sixteen bits will be selected by multiplexer 42 responsive to each rising edge of pixel clock signal PCLK. Therefore, upon the first rising edge of pixel clock signal PCLK after data for pixels n, n+1 appear at the output of second stage latch 34, multiplexer 42 applies the data for pixel n at its output (shown as line $OUT_{42}$ in FIG. 5*a*). Upon the next rising edge of pixel clock signal PCLK thereafter, data for pixel n+1 will be selected by multiplexer 42 and presented at its output.

As discussed hereinabove, in multiplexed mode the output of multiplexer 42 will be applied, via processor 46 in the conventional manner, to color palette RAM 48. The output of color palette RAM 48 corresponding to the pixel data presented thereto will then be passed through highlight logic 50 (assuming no cursor at this location), for application to DACs 52 and control of the monitor. It should be noted that the delays of the pixel data through this back-end processing in VDAC 30 are easily accounted for in synchronizing the operation of VDAC 30 with the monitor; in effect, a certain amount of "pipelining" is present within the data path of VDAC 30 between first stage latch 32 and the analog RGB output.

As a result of this operation in multiplexed mode, it should be noted that the significant cycle time limitations of the system of FIGS. 2*a* and 2*b* are overcome. Particularly, it should be noted that the propagation delay $t_{pd}$ between corresponding edges of clock signal OUTCLK and clock signals VCLK and LCLK is no longer a factor in the operation of the system. This is due primarily to the decoupling of clock signal OUTCLK from first stage latch 32, and to the additional stage of pipelining within VDAC 30. In the system of FIG. 4, the following relationship must be maintained:

$$t_{cyc} \geqq t_{ac} + t_{su}$$

with $$N(t_{pcyc}) = t_{cyc}$$

where N is the multiplexing coefficient. Using the same assumptions as described hereinabove relative to FIG. 2*b*, with N equals 2, $t_{ac}$ on the order of 25 nsec, and $t_{su}$ on the order of 4 nsec, $t_{pcyc}$ must be only 14.5 nsec or greater in order for the system to operate. Removal of the propagation delay time through video controller 70 thus greatly improves the data rate of VDAC 30 compared to the prior configuration.

Figure 5B:
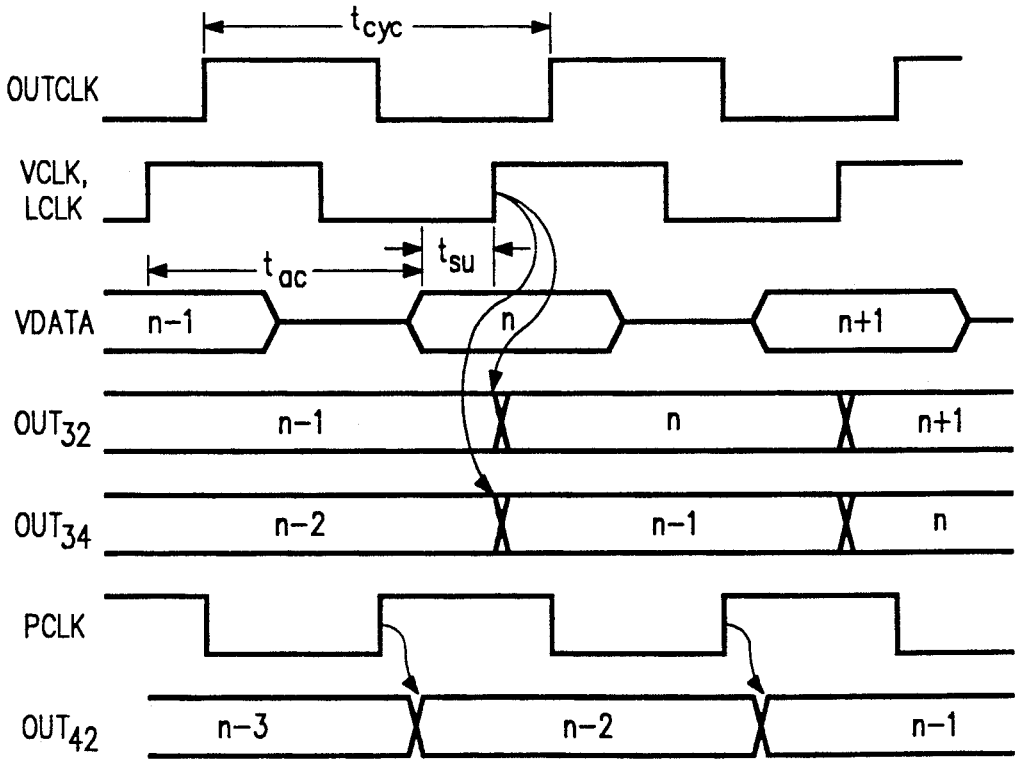

This improvement in the data rate, which allows for a faster $t_{pcyc}$ to be used, enables non-multiplexed modes, such as twenty-four bit true color mode, to be used with relatively high density displays. As described hereinabove relative to its construction VDAC 30 allows for such a non-multiplexed (or 1:1 multiplexed) mode. Referring now to FIG. 5*b*, the operation of such a mode will now be described.

As in the case of the multiplexed mode, VDAC 30 receives pixel clock signal PCLK from high speed oscillator 18, and generates clock signal OUTCLK therefrom by way of divide-by-N circuit 38. In this mode, however, command registers 40 control divide-by-N circuit such that clock signal OUTCLK is at the same frequency as pixel clock signal PCLK (i.e., N equals 1). Also as in the prior case, video processor 70 receives clock signal OUTCLK and generates clock signals VCLK and LCLK therefrom. Responsive to the rising edge of clock signal VCLK, the serial port of VRAM 14 will present pixel data on bus VDATA, at least as early as the access time $t_{ac}$ thereof. In this mode, however, each pixel is represented by twenty-four bits, in three groups of eight bits representative of the desired intensity for each of the red, green and blue guns in the CRT monitor. Accordingly, data for only one pixel is obtained by each access of the serial port of VRAM 14 in this mode.

Upon the next rising edge of clock signal LCLK after data for a pixel (e.g., pixel n) appears on bus VDATA, first stage latch 32 will latch in the pixel data. In this non-multiplexed mode, command registers 40 control clock multiplexer 36 to select clock signal LCLK to also control the latching of second stage latch 34, so that the prior contents of first stage latch 32 are latched into second stage latch 34, in master-slave fashion. Accordingly, upon the next rising edge of clock signal LCLK after data for pixel n appears on bus VDATA, first stage latch 32 stores and presents data for pixel n, and second stage latch 34 stores and presents data for pixel n−1 (the prior contents of first stage latch 32 in non-multiplexed mode). The outputs of latches 32 and 34 are shown in FIG. 5*b* relative to lines $OUT_{32}$ and $OUT_{34}$, respectively.

Command registers 40 also indicate to multiplexer control circuit 44 that non-multiplexed mode is enabled. As a result, all twenty-four bits communicated to the input of multiplexer 42 are presented at its output responsive to each rising edge of clock signal LCLK, which multiplexer control circuit 44 selects for application to line MUXCLK to multiplexer 42. Upon the first rising edge of clock signal MUXCLK after second stage latch 34 has latched in the data for pixel n−1, multiplexer 42 will present this data for pixel n−1 at its output. Upon completion of the next successive clock cycle of clock signal MUXCLK (and clock signals OUTCLK and LCLK), data for pixel n will appear at the output of multiplexer 42.

Also in non-multiplexed mode, color palette RAM 48 operates in a segmented fashion, so that it considers the output of multiplexer 42 in groups of eight bits (for example), each group presenting a digital intensity value for a corresponding DAC 52. The output of color palette RAM 48, corresponding to an adjusted intensity value depending upon the particularly display system, is communicated to highlight logic 50. True color data stored in and presented by VRAM 14 to VDAC 30 is thus converted by DACs 52 to the proper analog form for application to the display device.

Similarly as in the example described hereinabove relative to FIG. 5*a*, the cycle time $t_{cyc}$ (which is the same as the cycle time of pixel clock signal PCLK, and clock signal LCLK) does not include the propagation delay through video processor 70. As a result, using the same access times as noted hereinabove for the example of FIG. 5*a*, the pixel clock rate for the non-multiplexed mode need be 34 nsec or greater in order to allow for the access and setup times of the system. True color data can thus be driven to a relatively high density display (on the order of 700 pixels on a side) by this embodiment of the invention, even where the access and setup times are modest.

While the invention has been described herein relative to its preferred embodiment, it is of course contemplated that modifications of, and alternatives to, this embodiment, such modifications and alternatives obtaining the advantages and benefits of this invention, will be apparent to those of ordinary skill in the art having reference to this specification and its drawings. It is contemplated that such modifications and alternatives are within the scope of this invention as subsequently claimed herein.

We claim:

1. A video display driver circuit, comprising:

a first clock terminal for receiving a pixel clock signal;

a second clock terminal for receiving a latch clock signal;

an output clock terminal;

a frequency divider circuit, for receiving the pixel clock signal from said first clock terminal, and for presenting, at said output clock terminal, an output clock signal having a period which is a multiple of the period of said pixel clock signal;

a plurality of data terminals for receiving pixel data;

a latch, coupled to said data terminals and to said second clock terminal, for storing pixel data received at said data terminals responsive to said latch clock signal;

a multiplexer, having a data input coupled to said latch for receiving said pixel data, having a clock input coupled to receive said pixel clock signal, and having an output, said multiplexer for applying a selected portion of said pixel data to its output responsive to said pixel clock signal; and output circuitry coupled to the output of said multiplexer, for presenting said pixel data to a display device.

2. The circuit of claim 1, further comprising:

means, coupled to said latch and said multiplexer, for synchronizing the application of said pixel data to said pixel clock signal.

3. The circuit of claim 1, wherein said output circuitry comprises:

a palette memory for storing a plurality of color codes, having an address input coupled to the output of said multiplexer, and having a data output, said palette memory presenting a color code at its data output responsive to receiving pixel data at its address input, said pixel data indicating the address in said palette memory corresponding to the desired color code.

4. The circuit of claim 1, wherein said output circuitry comprises:

a plurality of digital-to-analog converters, each for receiving a portion of said pixel data corresponding to a display component and for converting said received portion of said pixel data to an analog signal corresponding to the intensity of a display component.

5. The circuit of claim 4, wherein said output circuitry further comprises:

a segmented palette memory for storing a plurality of color codes, comprising:

a plurality of address inputs, each address input corresponding to a display component and coupled to a portion of the output of said multiplexer;

storage locations grouped into a plurality of groups, each group of storage locations corresponding to a display component and addressable according to a value applied to the address input corresponding to its display component;

a plurality of data outputs, each corresponding to a display component and coupled to the input of the digital-to-analog converters associated with its display component, for presenting the storage location corresponding to the value applied to the address input corresponding to its display component.

6. The circuit of claim 1, wherein said frequency divider circuit is controllable to select among a plurality of multiples of said period of said pixel clock signal.

7. The circuit of claim 1, further comprising:

means for selecting the portion of said pixel data to be applied by said multiplexer to its output responsive to said pixel clock signal.

8. The circuit of claim 7, wherein said selecting means also selects the multiple of said period of said pixel clock signal.

9. A data processing apparatus, comprising:

a frame memory, having an output connected to a pixel bus, for presenting pixel data responsive to receiving a memory clock signal;

a clock source for generating a pixel clock signal;

a frequency divider circuit, for receiving the pixel clock signal and for generating an output clock signal having a period which is a multiple of the period of said pixel clock signal;

a clock controller having an input receiving said output clock signal, for generating said memory clock signal and a latch clock signal based on said output clock signal;

a latch, coupled to said pixel bus, for storing pixel data on said pixel bus responsive to said latch clock signal;

a multiplexer, having a data input coupled to said latch for receiving said pixel data and having a clock input coupled to receive said pixel clock signal, for selecting a selected portion of said pixel data responsive to said pixel clock signal; and output circuitry coupled to said multiplexer, for presenting said selected portion of said pixel data to a display device.

10. The apparatus of claim 9, further comprising:

means, coupled to said latch and said multiplexer, for synchronizing the application of said pixel data to said pixel clock signal.

11. The apparatus of claim 10, further comprising:

a palette memory for storing a plurality of color codes, having an address input coupled to the output of said multiplexer, and having a data output coupled to said output circuitry, said palette memory presenting a color code at its data output responsive to receiving pixel data at its address input, said pixel data indicating the address in said palette memory corresponding to the desired color code.

12. The apparatus of claim 9, wherein said frequency divider circuit is controllable to select among a plurality of multiples of said period of said pixel clock signal.

13. The apparatus of claim 12, further comprising:

means for selecting the portion of said pixel data to be applied by said multiplexer to its output responsive to said pixel clock signal and for selecting the multiple of said period of said pixel clock signal.

14. The apparatus of claim 9, wherein said output circuitry comprises:

a plurality of digital-to-analog converters, each for receiving a portion of said pixel data corresponding to a display color, each for converting said pixel data to an analog signal corresponding to the intensity of its corresponding display color; and a segmented palette memory for storing a plurality of color codes, comprising:

a plurality of address inputs, each coupled to a portion of the output of said multiplexer corresponding to a display color;

a plurality of data outputs, each coupled to one of said digital-to-analog converters corresponding to a display color; for presenting a color code responsive to the portion of the output of said multiplexer corresponding to its display color.

15. The apparatus of claim 9, further comprising:

a video processor, coupled to said frame memory, for accessing said frame memory and for storing data therein corresponding to an image to be displayed;

a host processor, coupled to said video processor by way of a host bus; and a display device, coupled to said output circuitry.

16. A method of generating image information for application to a display device, comprising the steps of:

storing an image in a frame memory;

generating a pixel clock signal having a first period;

generating an output clock signal having a second period, said second period being a multiple of said first period;

generating a memory clock signal and a latch clock signal from said output clock signal;

applying said memory clock signal to said frame memory, said frame memory applying data stored therein to a video bus, said data corresponding to a plurality of pixels of said image;

applying said latch clock signal to a latch connected to said video bus, said latch storing said data corresponding to a plurality of pixels responsive to said latch clock signal;

selecting a portion of said latched data corresponding to a pixel, responsive to said pixel clock signal; and applying said selected portion of latched data to said display device.

17. The method of claim 16, wherein said multiple equals the number of pixels in said plurality of pixels.

18. The method of claim 17, wherein said selecting step is repeated for each pixel in said plurality of pixels.

19. The method of claim 17, wherein said multiple equals one.

20. The method of claim 16, wherein said memory clock signal and said latch clock signal are phase synchronous.

* * * * *

UNITED STATES PATENT AND TRADEMARK OFFICE

CERTIFICATE OF CORRECTION

PATENT NO. : 5,291,187

DATED : March 1, 1994

INVENTOR(S) : Paul B. Wood
Brian F. Bounds

It is certified that error appears in the above-indentified patent and that said Letters Patent is hereby corrected as shown below:

Col. 4, line 42, delete "$t_{cyc} \geq t_{pd} + t_{ac} + t_{su}$", insert

--$t_{cyc} \geq t_{pd} + t_{ac} + t_{su}$--.

Col 16, line 55, delete "$t_{cyc} \geq t_{ac} + t_{su}$", insert

--$t_{cyc} \geq t_{ac} + t_{su}$--.

Signed and Sealed this

Sixteenth Day of May, 1995

*Attest:*

*Attesting Officer*

Bruce Lehman

BRUCE LEHMAN

*Commissioner of Patents and Trademarks*